US005121846A

United States Patent [19]

Adams et al.

[11] Patent Number: 5,121,846

[45] Date of Patent: Jun. 16, 1992

[54] PLASTIC CUP HAVING PARTIALLY EXTERNAL TEAR GROOVE

[75] Inventors: Brian M. Adams, Newark; Daniel Luch, Los Gatos, both of Calif.

[73] Assignee: Cap Snap Co., San Jose, Calif.

[21] Appl. No.: 742,645

[22] Filed: Aug. 7, 1991

[51] Int. Cl.[5] ..... B65D 41/48

[52] U.S. Cl. ..... 215/256

[58] Field of Search ..... 215/253, 254, 255, 256; 220/266, 270, 276

[56] References Cited

U.S. PATENT DOCUMENTS

| | | | |
|---|---|---|---|
| 3,392,862 | 7/1968 | Faulstich | 215/254 |
| 3,434,613 | 3/1969 | Langecker | 215/256 |
| 4,815,617 | 3/1989 | Cullum | 215/232 |
| 4,911,316 | 3/1990 | Tackles | 215/256 |

*Primary Examiner*—Stephen P. Garbe
*Assistant Examiner*—Nova Stucker
*Attorney, Agent, or Firm*—Julian Caplan

[57] ABSTRACT

A plastic cap for closing the neck of a conventional 5-gallon bottle or similar container is characterized by having an upper external convex bead immediately below the neck lip, a concavity below the upper bead and a lower convex bead. The cap has a top disc and a peripheral depending skirt. The skirt has an upper seal bead to engage the upper neck bead, a tensioning bead to engage the undersurface of the upper seal bead and a lower seal bead to engage the lower convex bead. Below the tensioning bead is a horizontal internal score line. Extending downwardly from the horizontal score line is a second score line curving downwardly and then in a substantially vertical stretch. A tear tab extends down from the bottom edge of the skirt. To open the bottle, the user pulls the tear tab to tear the skirt upward along the second score line, then around the horizontal score line. The cap is distinctive in that, along the vertical stretch crossing the lower internal seal bead, the second score line is external and above the vertical stretch is internal. Locating the vertical stretch external improves the contact of the lower cap seal bead against the lower external neck bead since the second score line does not cut through it. Making the horizontal score line and the portion of the second score line above the lower internal skirt bead internal reduces the likelihood of the skirt splitting when it is applied to the neck.

5 Claims, 7 Drawing Sheets

PLASTIC CUP HAVING PARTIALLY EXTERNAL TEAR GROOVE

BACKGROUND OF THE INVENTION

1. Field of the Invention

This invention relates to a new and improved plastic cap for a large container such as a 5-gallon water bottle having a partially external tear groove. More particularly, the invention relates to a cap which fits over a conventional large bottle neck by a snap-on action. The cap is tamper-evident in that the lower portion of the cap must be torn off before the cap can be removed. Accordingly, the cap is formed with a horizontal score line and a downward-extending second score line which terminates at the bottom edge of the skirt of the cap. The cap, preferably, but not necessarily, adjacent its lower edge has an internal seal bead which seals against the neck of the bottle. Accordingly, the second score line comprises an external groove in the outer surface of the cap and then becomes an internal score line extending upward to the internally scored horizontal score line. Where a lower bead is used, the transition from external to internal score line occurs after it crosses the lower bead.

2. Description of Related Art

Caps of the above-identified general type have been widely used in the bottled water industry for many years and are evidenced by such U.S. Pat. Nos. as 3,392,860; 3,392,862; 2,840,137; 3,979,002; and 4,911,316. Thus, the exterior of the neck of the bottle has a convex upper bead near the top lid which merges into a concave portion below the top bead and then merges into a convex lower bead. The cap has a top disc which engages the lip of the bottle and an outward bulge below the lip which fits over the top convex neck bead. The skirt of the cap below the bulge extends downward and engages the lower convex neck bead. Once the cap is snapped in place on the neck, it cannot be removed without tearing off the lower portion of the skirt and thus the cap is said to be tamper-evident. In order to remove the lower portion of the skirt, a horizontal score line is formed on the interior of the cap below the bulge and a downward curved second score line extends to the bottom edge of the skirt. By pulling a tear tab which projects below the bottom of the skirt adjacent the bottom terminus of the second score line, the cap may be torn upwardly along the second score line and then at least partially around the horizontal score line, making it possible to remove the cap.

The present invention differs from these prior art references in that the second score line extending up from the bottom edge of the skirt is external, whereas the remaining portion of the second score line and the first score line are internal. Hence there is no interruption of the lower seal bead of the cap which would otherwise interfere with the integrity of its sealing function. Thus if there is an irregularity in the surface of the lower convex neck bead—such as a mold parting line—the integrity of the seal is not affected.

Optionally, the cap has an internal second bead. The integrity of this bead is not affected since the second score line is on the outer surface.

SUMMARY OF THE INVENTION

As has previously been stated, the cap optionally provides a means for effectively sealing the lower edge of the skirt against the external convex lower bead of the neck of the bottle by providing an internal seal bead which engages the bottle neck. The second score line is external as it crosses the optional lower skirt seal bead and does not interrupt continuous contact of the bottom skirt bead with the lower convex neck bead.

Further, if the lower convex neck bead has an irregularity, such as a mold parting line, the cap skirt seals against the neck bead and this seal is not impaired by the second score line since it is on the outer surface of the skirt.

Hence, dirt and other contaminants do not intrude from the exterior under the cap skirt. Additionally, any water or other liquid from the container which may not be effectively sealed by the other sealing means of the cap is prevented from leaking.

Above the lower internal skirt bead the second score line is internal, as is the horizontal score line. The skirt is less likely to split when the cap is applied to the neck using this construction.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
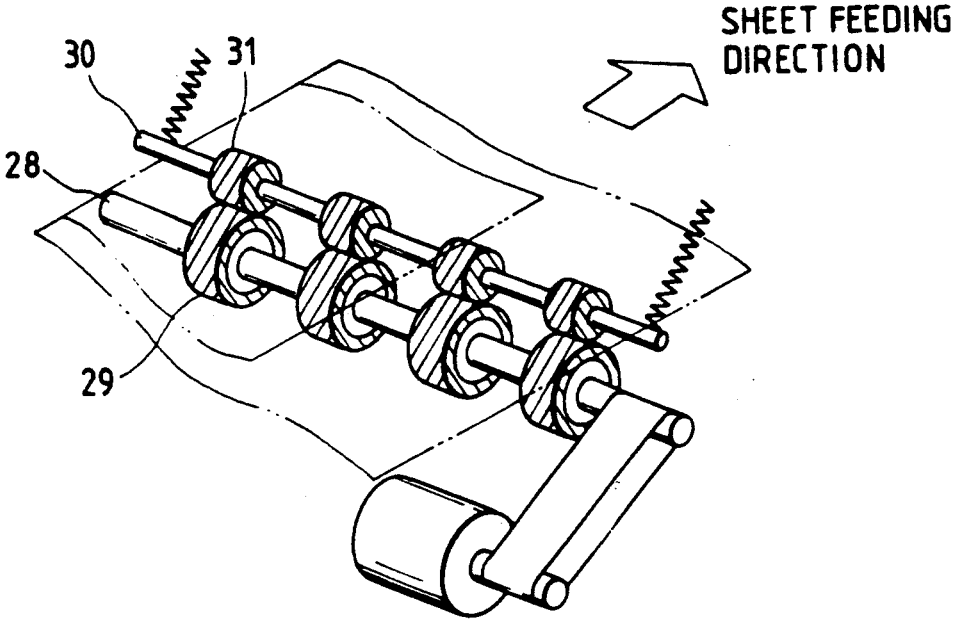
FIG. 1 is a side elevational view of the cap in accordance with the present invention partially broken away to reveal internal construction.
Figure 2:
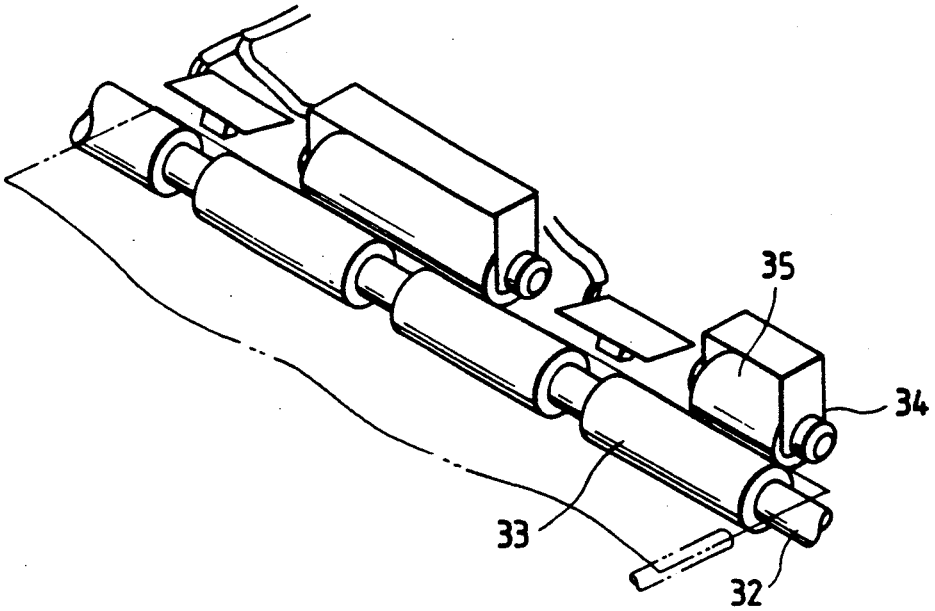
FIG. 2 is a vertical sectional view of a portion of the cap of FIG. 1 showing the points of contact with the neck of a bottle.
Figure 3:
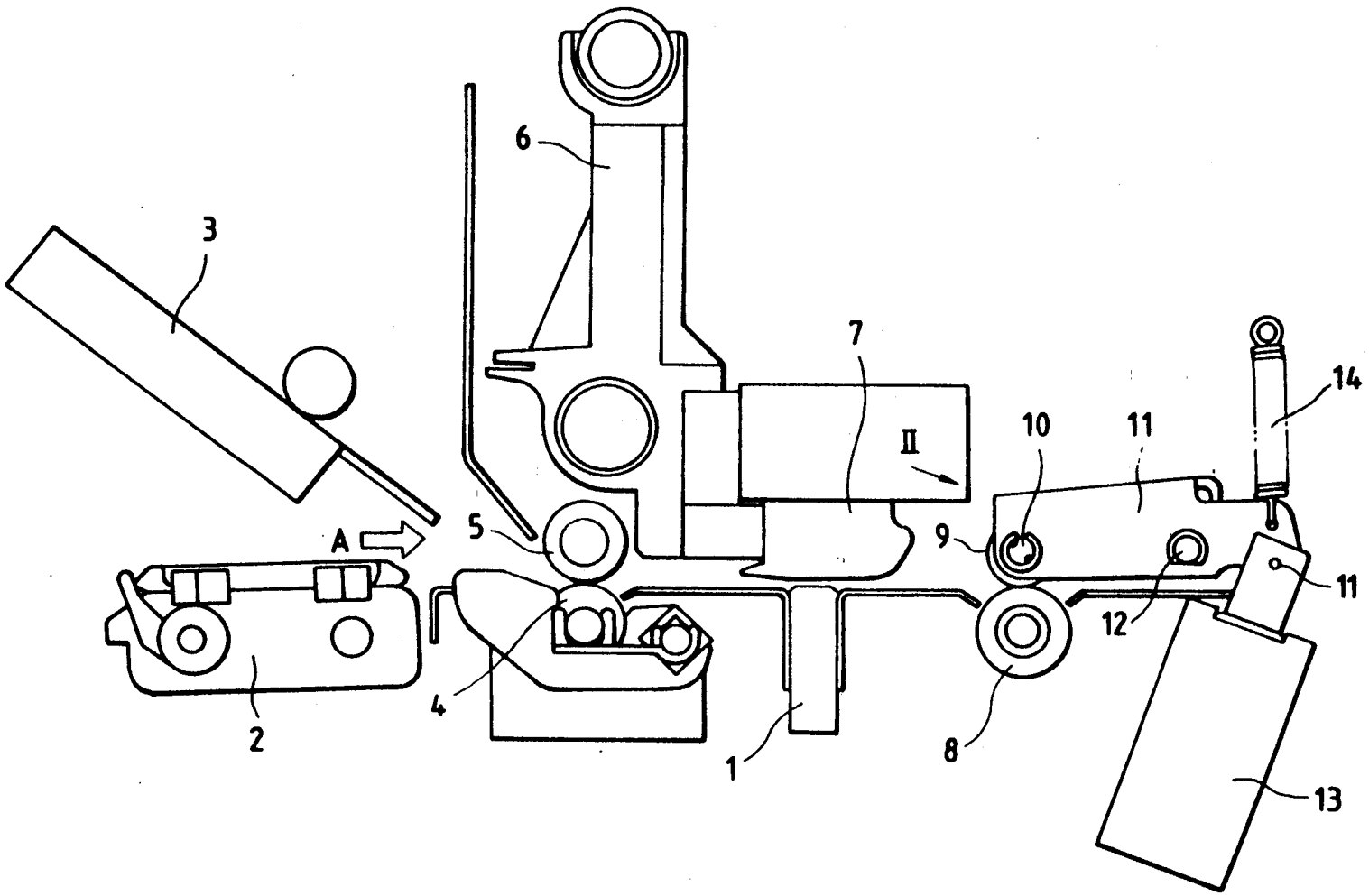
FIG. 3 is a view similar to FIG. 2 showing a modified neck structure.

Conventional bottle neck 11 has a top lip 12 below which is an upper external convex bead 13. Below bead 13 is a concavity 14 and below concavity 14 is a lower external convex bead 16 which may or may not be marred by a nick or other irregularity or a mold parting line. In FIG. 3 a modified construction is shown wherein the cross-section of bead **13*a* is more circular as is the concavity 14*a*, while the lower neck bead 16*a* is flatter than that shown in FIG. 2**.

Cap 21 has a top disc 22 which fits over the lip 12 and has a rounded corner 23 below disc 22 which merges into an outward bulge 25 generally paralleling the bead 13. Below the bulge 25 is cap skirt 24 which extends down bridging the concavity 14 and extending below the lower neck bead 16. Skirt 24 preferably seals against bead 16. The interior of cap 21 has a top internal seal bead 26 which engages the neck bead 13 and seals liquid from leaking. In order to increase the efficiency of the seal of bead 26, a tensioning bead 27 may be located in such position that it engages the under side of the bead 13 and exerts a "hoop effect" which draws the bulge 25 toward the bead 13 and forces the bead 26 into engagement with bead 13.

Optional lower internal seal bead 28 is located spaced upwardly from the bottom edge 29 of skirt 24 in such position that it engages the neck bead 16 and seals thereagainst. The cross-sectional shape of bead 28, if used, as shown in FIGS. 1–3 and 5, is triangular. Thus, there are converging top and bottom flanks 33 which intersect at a triangular tip 32 which engages bead 16.

Figure 4:
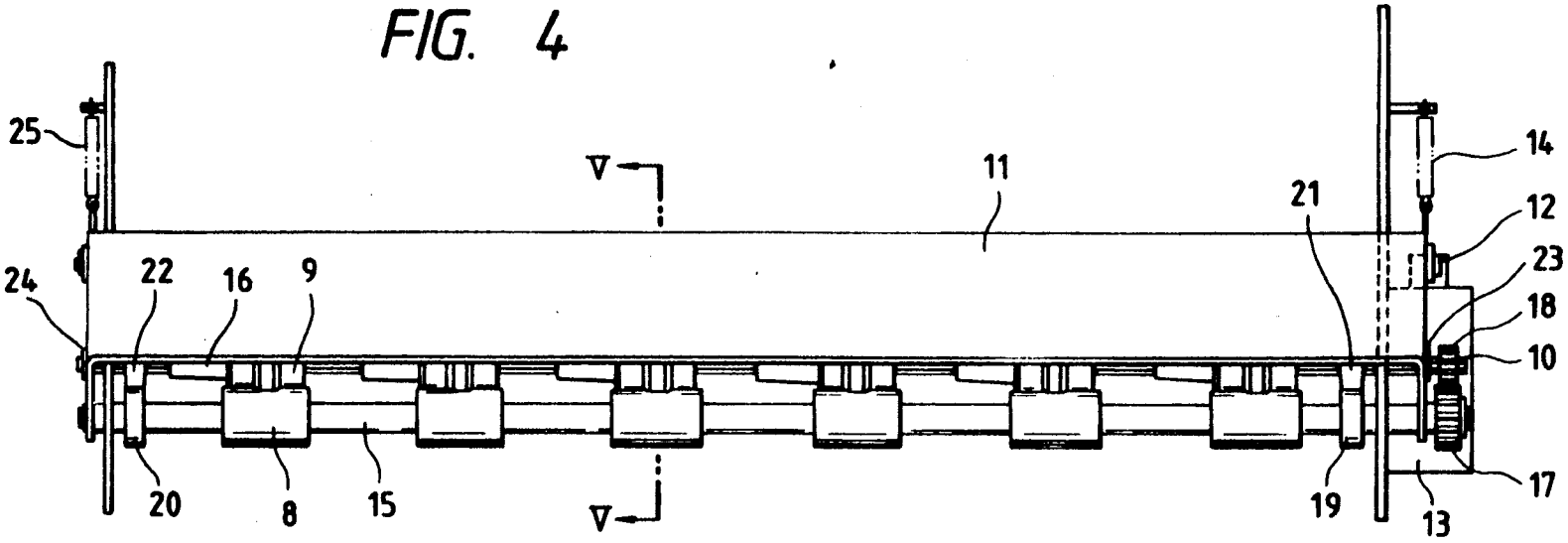
FIG. 4 is an enlarged sectional view through the lower skirt bead showing a modification of the structure of FIGS. 1 and 2.
Figure 5:
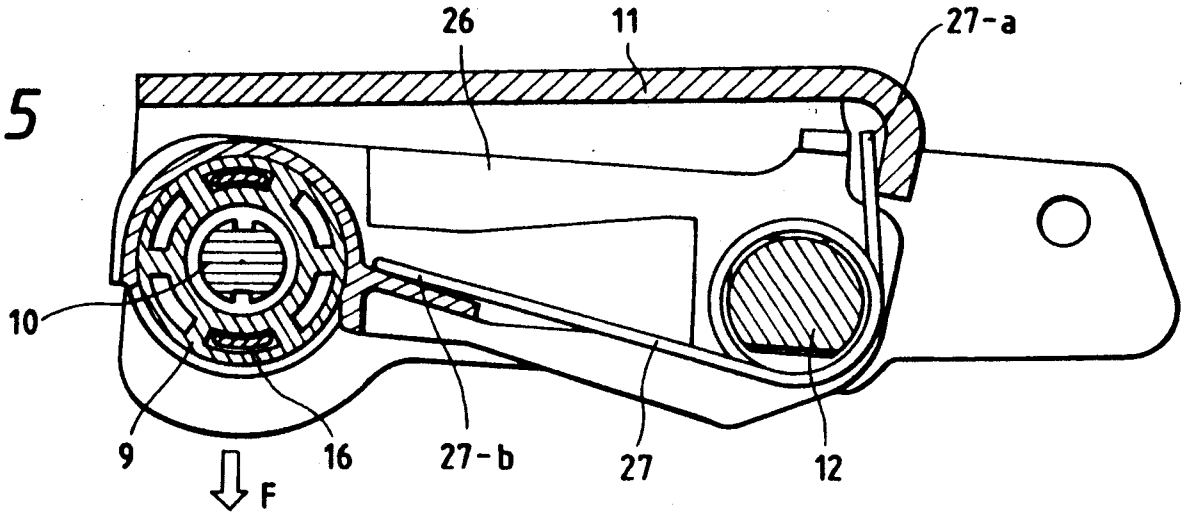
FIG. 5 is a view similar to FIG. 4 of another modification.

In FIG. 4, however, bead **28*a* has horizontal flanks which merge with a rounded tip 31**.

Figure 6:
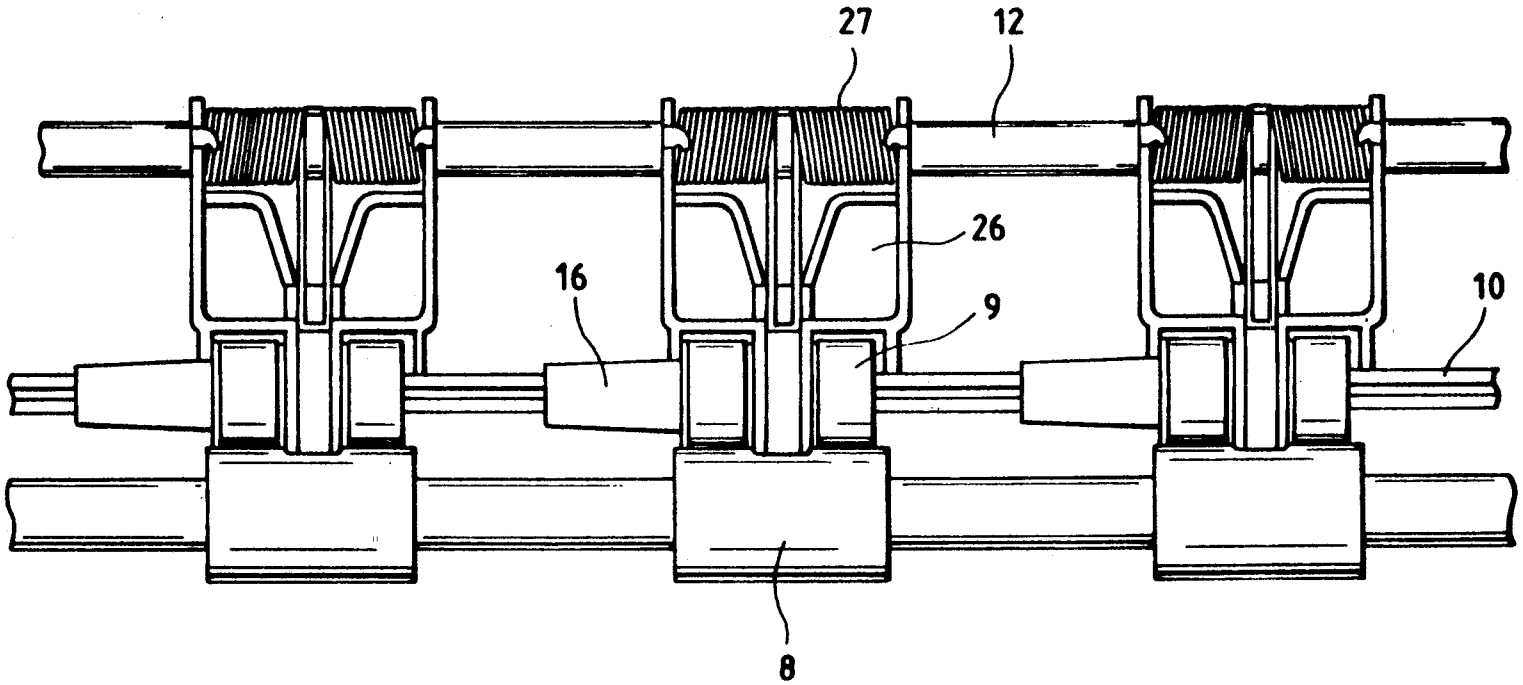
FIG. 6 is a view similar to FIG. 4 of still another modification.
Figure 7:
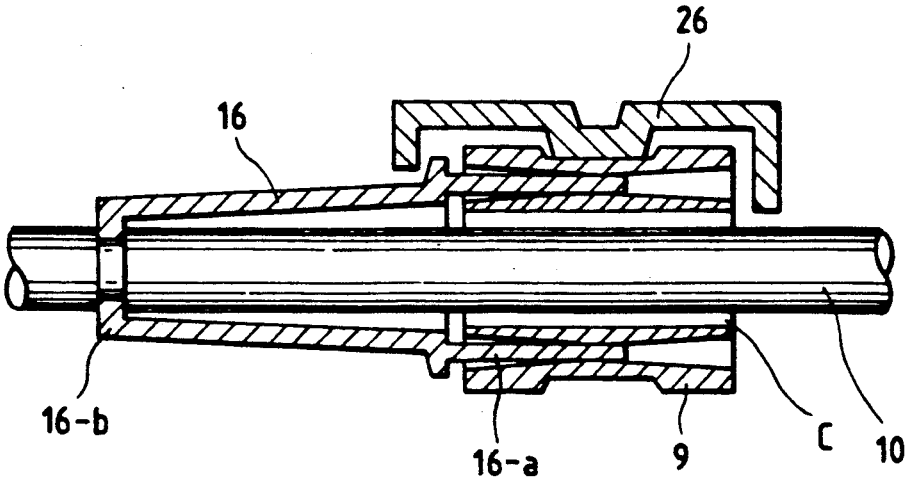
FIG. 7 is an enlarged sectional view taken substantially along the line 7—7 of FIG. 1 showing how the second score line is partially external and partially internal.
Figure 8:
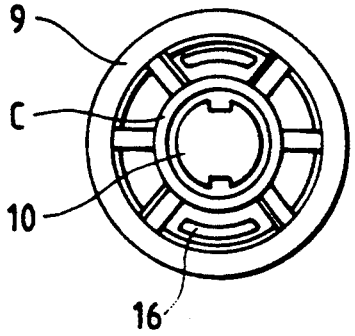
Figure 9:
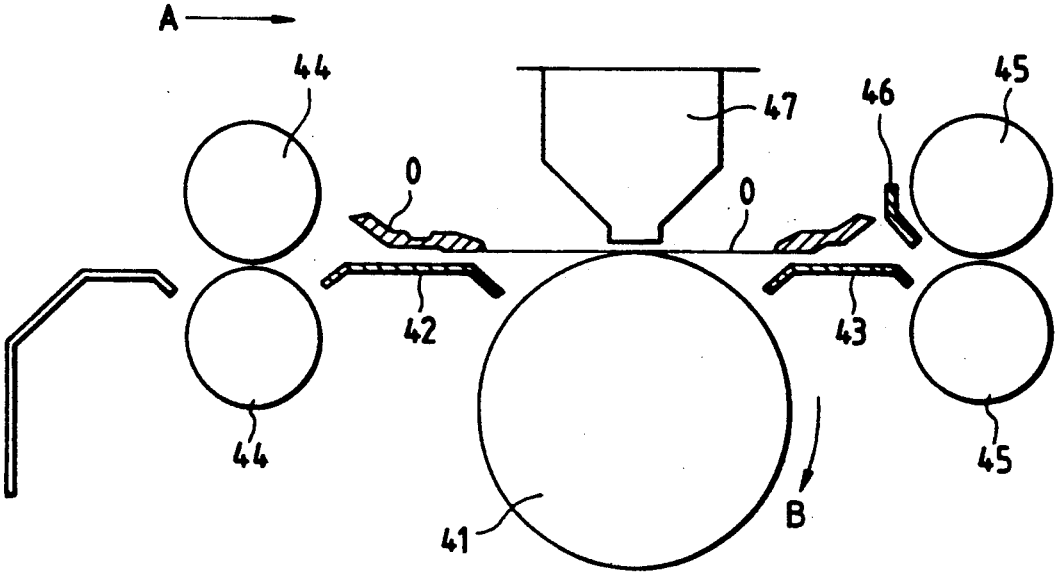
Figure 10:
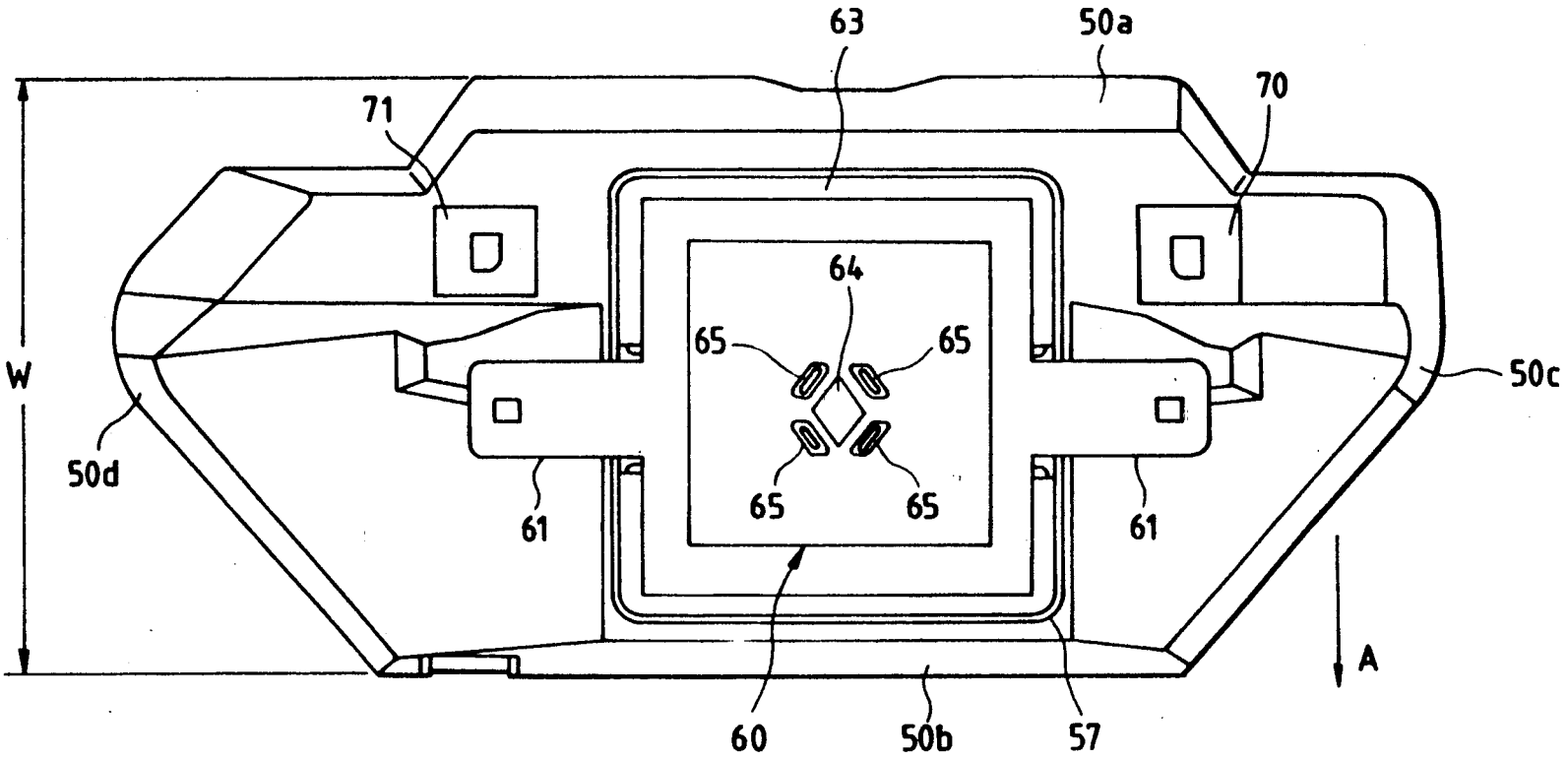
Figure 11:
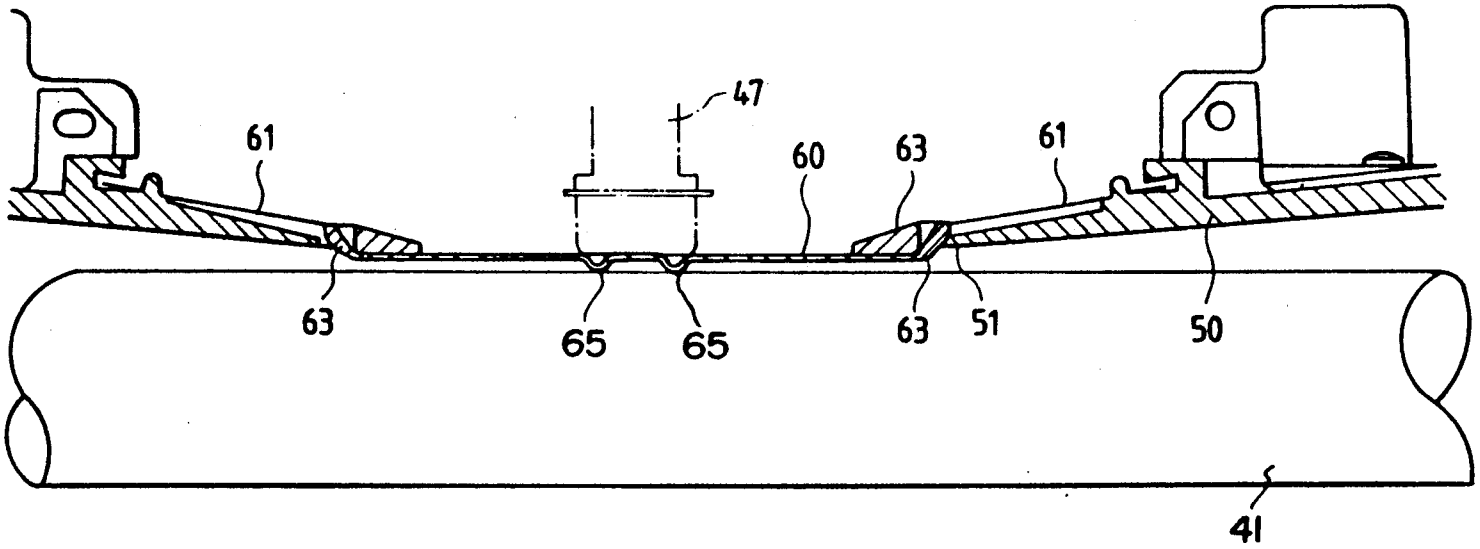
Figure 1:
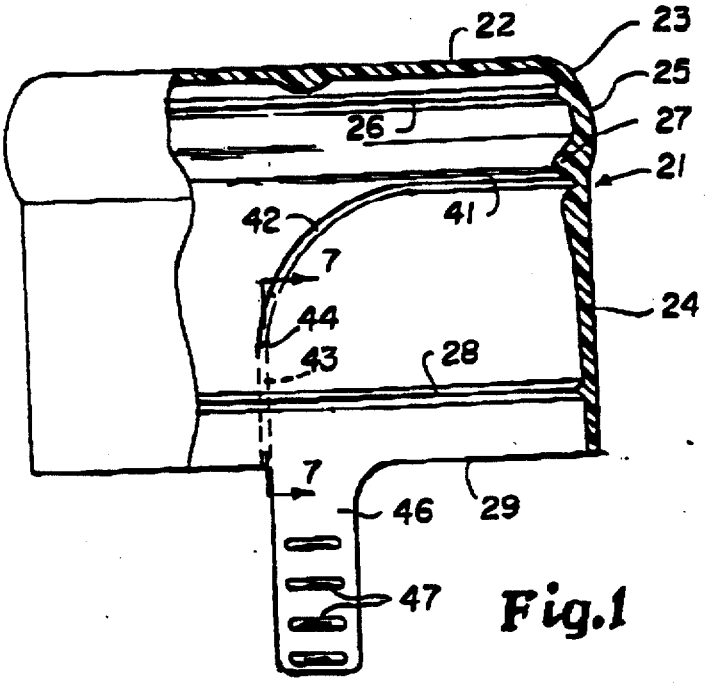
Figure 4:
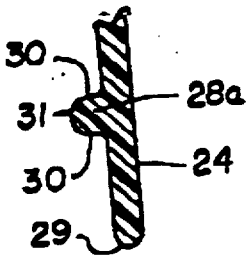
Figure 2:
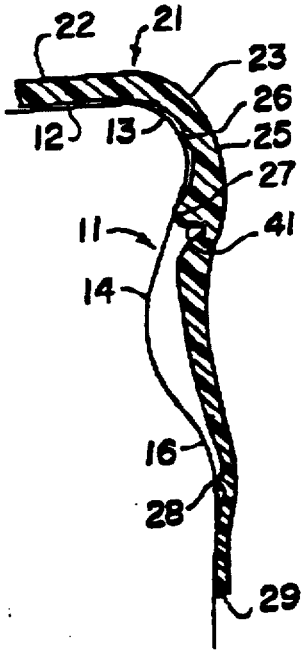
Figure 5:
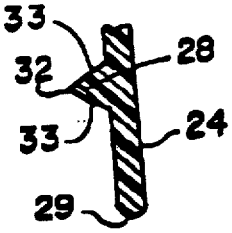
Figure 3:
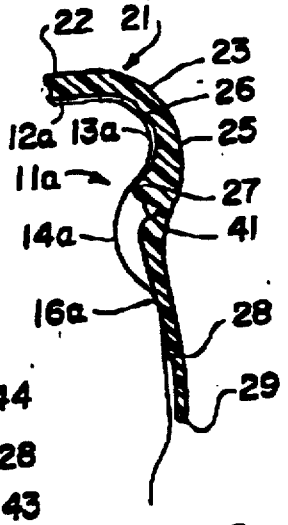
Figure 6:
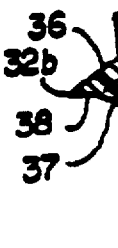
Figure 7:
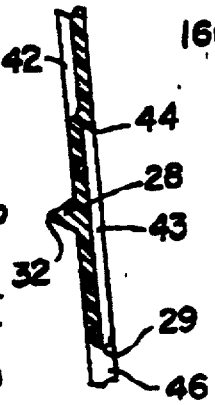

In FIG. 6 a further modified bead **28*b* is shown. In this modification, the top flank 36 extends downward to tip 32*b*, whereas the lower or bottom flank 37 extends upwardly and then merges with a slightly downwardly slanted outer flank 38 which extends to the tip 32*b*. The bead 28*b* of FIG. 6 is particularly flexible and accommodates irregularities in the surface of neck bead 16**. Other internal beads of other shapes may be used.

As has been stated, the cap 21 is tamper-evident in that once it has been snapped onto neck 11 it cannot be removed so long as the lower portion of skirt 24 remains intact. In order to make it possible to remove the lower skirt portion, the cap is formed with an internal horizontal score line 41 located below tensioning bead 27. Intersecting and merging with score line 41 is a second curved score line 42, which is also internal, and extends downward to a terminus 44 adjacent bead 28. Below the terminus 44 of score line 42 the score line 43 is external and extends vertically downward to the bottom edge 29 of the skirt 24. Terminus 44 is located above bead 16 and above bead 28, when used. Thus, when the vertical stretch 43 intersects the optional bead 28, it is on the opposite side of the skirt from the bead 28 and hence does not interrupt the continuous sealing action of the bead 28.

In order to remove the lower portion of the cap, a tear tab 46 extends down from bottom edge 29 adjacent the lower terminus of stretch 43. Such a tab 46 may be provided with horizontal gripping ribs 47. In use, the consumer grips the tab 46 and pulls upward, first tearing the skirt 24 vertically along the stretch 43 and then along the stretch 42. Continued pulling of the tab 46 causes the line 41 to be torn sufficiently to make it possible to remove the cap from the neck 11.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A bottle cap having a top disc, a skirt depending from said disc having a lower edge, an internal horizontal score spaced downward from said top disc and a second score line merging with said horizontal score line at its upper end and extending down to said lower edge, said second score line being formed on the outer surface of said skirt extending upward from said lower edge and on the inner surface of said skirt adjacent said horizontal score line, said skirt having an internal seal bead spaced upward from said lower edge, said second score line being external as it crosses said internal seal bead.

2. A cap according to claim 1 in which said second score line has a curved stretch below said horizontal score line and a substantial vertical stretch below said curved stretch, said curved stretch being internal and said vertical stretch external relative to said skirt.

3. A cap according to claim 1 in which said internal seal bead is triangular in cross section.

4. A cap according to claim 1 in which said internal seal bead has substantially horizontal flanks and a rounded tip.

5. A cap according to claim 1 in which said internal seal bead has a downward slanted top flank, a bottom flank adjacent said skirt at an angle of about 60° relative to said top flank and an outer end flank outward of said bottom flank, said outer end flank at an angle of about 20° to said top flank.

* * * * *

UNITED STATES PATENT AND TRADEMARK OFFICE

CERTIFICATE OF CORRECTION

PATENT NO. : 5,121,846

DATED : June 16, 1992

INVENTOR(S) : Brian M. Adams, et. al.

It is certified that error appears in the above-identified patent and that said Letters Patent is hereby corrected as shown below:

On the Title page, the Title should be deleted to appear as per attached page.

Figures 1-11 should be deleted to be replaced with figures 1-7 as shown on the attached sheet.

Signed and Sealed this

Twenty-fifth Day of May, 1993

*Attest:*

Michael K. Kirk

MICHAEL K. KIRK

*Attesting Officer*

*Acting Commissioner of Patents and Trademarks*

United States Patent [19]

Adams et al.

[11] Patent Number: 5,121,846

[45] Date of Patent: Jun. 16, 1992

[54] PLASTIC CUP HAVING PARTIALLY EXTERNAL TEAR GROOVE

[75] Inventors: Brian M. Adams, Newark; Daniel Luch, Los Gatos, both of Calif.

[73] Assignee: Cap Snap Co., San Jose, Calif.

[21] Appl. No.: 742,645

[22] Filed: Aug. 7, 1991

[51] Int. Cl.[5] ..... B65D 41/48

[52] U.S. Cl. ..... 215/256

[58] Field of Search ..... 215/253, 254, 255, 256; 220/266, 270, 276

[56] References Cited

U.S. PATENT DOCUMENTS

| | | | |
|---|---|---|---|
| 3,392,862 | 7/1968 | Faulstich | 215/254 |
| 3,434,613 | 3/1969 | Langecker | 215/256 |
| 4,815,617 | 3/1989 | Cullum | 215/232 |
| 4,911,316 | 3/1990 | Tackles | 215/256 |

*Primary Examiner*—Stephen P. Garbe
*Assistant Examiner*—Nova Stucker
*Attorney, Agent, or Firm*—Julian Caplan

[57] ABSTRACT

A plastic cap for closing the neck of a conventional 5-gallon bottle or similar container is characterized by having an upper external convex bead immediately below the neck lip, a concavity below the upper bead and a lower convex bead. The cap has a top disc and a peripheral depending skirt. The skirt has an upper seal bead to engage the upper neck bead, a tensioning bead to engage the undersurface of the upper seal bead and a lower seal bead to engage the lower convex bead. Below the tensioning bead is a horizontal internal score line. Extending downwardly from the horizontal score line is a second score line curving downwardly and then in a substantially vertical stretch. A tear tab extends down from the bottom edge of the skirt. To open the bottle, the user pulls the tear tab to tear the skirt upward along the second score line, then around the horizontal score line. The cap is distinctive in that, along the vertical stretch crossing the lower internal seal bead, the second score line is external and above the vertical stretch is internal. Locating the vertical stretch external improves the contact of the lower cap seal bead against the lower external neck bead since the second score line does not cut through it. Making the horizontal score line and the portion of the second score line above the lower internal skirt bead internal reduces the likelihood of the skirt splitting when it is applied to the neck.

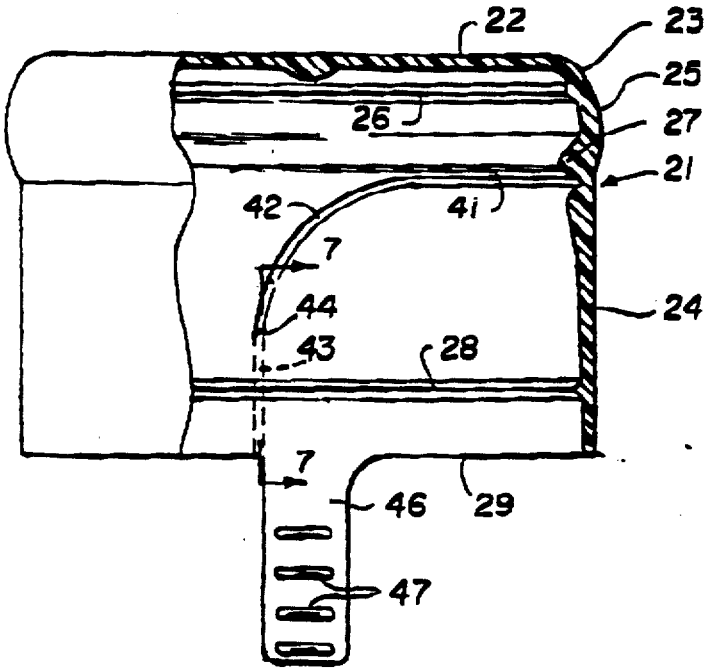

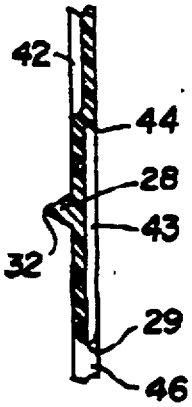

5 Claims, 7 Drawing Sheets